US005707092A

United States Patent [19]

Van Slembrouck et al.

[11] Patent Number: 5,707,092

[45] Date of Patent: Jan. 13, 1998

[54] SELF-ALIGNING LOOP STRIKER

[75] Inventors: Mark Leonard Van Slembrouck, Clinton Township; Frank Joseph Arabia, Jr., Macomb Township, both of Mich.

[73] Assignee: General Motors Corporation, Detroit, Mich.

[21] Appl. No.: 757,733

[22] Filed: Nov. 26, 1996

[51] Int. Cl.[6] ..... E05B 15/02

[52] U.S. Cl. ..... 292/341.19; 292/341.12; 292/341.17

[58] Field of Search ..... 292/216, 341, 292/341.12, 341.13, 341.17, 341.18, 341.19

[56] References Cited

U.S. PATENT DOCUMENTS

| | | | |
|---|---|---|---|
| 4,225,166 | 9/1980 | Tanaka et al. | 292/341.17 |
| 4,323,271 | 4/1982 | Taniguchi | 292/341.18 |
| 4,470,626 | 9/1984 | Gergoe et al. | 292/341.12 |
| 4,707,007 | 11/1987 | Inoh | 292/341.18 |
| 4,756,563 | 7/1988 | Garwood et al. | 292/216 |
| 5,125,698 | 6/1992 | Thau | 292/341.12 |
| 5,316,354 | 5/1994 | Arabia, Jr. et al. | 292/340 |
| 5,342,103 | 8/1994 | Tame et al. | 292/341.17 |
| 5,529,356 | 6/1996 | Cetnar | 292/341.12 |

FOREIGN PATENT DOCUMENTS

| | | | |
|---|---|---|---|
| 3137373 | 6/1991 | Japan | 292/341.12 |

*Primary Examiner*—Neill R. Wilson
*Attorney, Agent, or Firm*—Lawrence B. Plant

[57] ABSTRACT

A loop-striker for use with a door latch of the type having (1) a bell-shaped mouth for receiving a complimentary wedge-shaped crossbar and a leading leg of the striker, and (2) a rotateable fork-bolt having a throat that traps the leading leg when the fork-bolt is in the latched condition. The striker is constructed such that the wedge-shaped crossbar can pivot about its leading leg so as to be self-aligning with respect to said mouth.

7 Claims, 2 Drawing Sheets

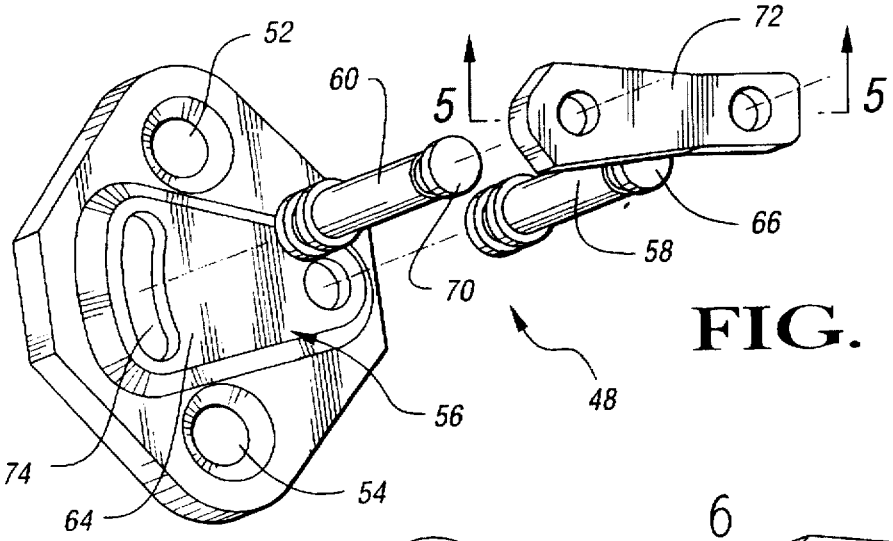
FIG. 3
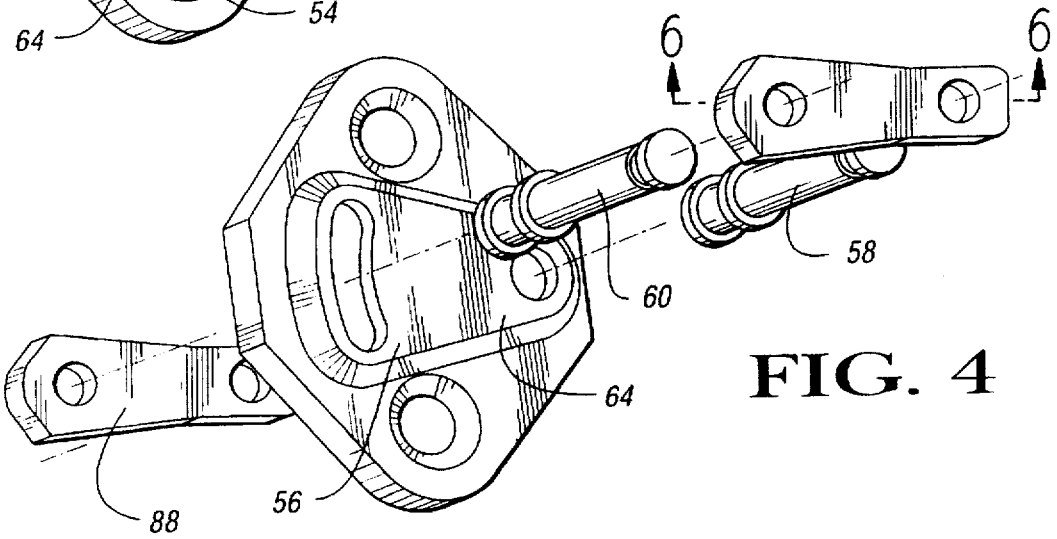
FIG. 4
FIG. 5
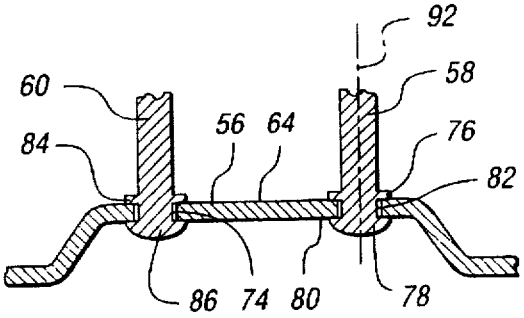
FIG. 6
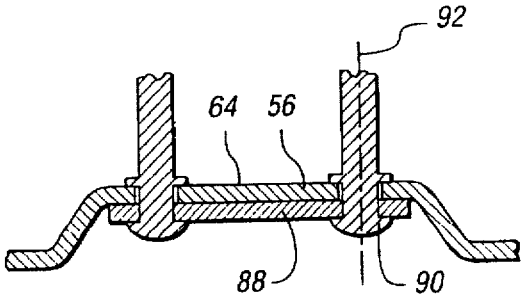

SELF-ALIGNING LOOP STRIKER

TECHNICAL FIELD

This invention relates generally to strikers for vehicle door latches, and more particularly to self-aligning, loop-type such latches having wedge-shaped crossbars.

BACKGROUND OF THE INVENTION

Vehicle door latches are well known in the art and serve to prevent unintended opening of the door. Latching mechanisms comprise various combinations of springs, gears, cams, levers, pivots and other such linkages, coacting to provide latching, unlatching, locking and unlocking functions, which mechanisms are well known in the art. One such latch is adapted to engage a loop-type striker which is a generally U-shaped member having two legs anchored to the doorframe (e.g., door jamb), and a crossbar extending between the legs outboard the doorframe. One such latch and loop-type striker design can be found in latches sold commercially by the General Motors Corporation, assignee of the present invention, and is disclosed in such as Garwood et al. U.S. Pat. Nos. 4,756,563 (issued Jul. 12, 1988), and Arabia, Jr. 5,316,354 (issued May 31, 1994), which patents are assigned to the assignee of the present invention. These patents and commercial latches are intended to be incorporated herein by reference. That design employs a loop-type striker wherein the crossbar between the striker's legs is generally wedge-shaped and nests within a substantially complimentary bell-shaped mouth in the latch's housing when the door is closed to prevent up and down movement of the door relative to the body when the door is closed. More specifically and referring to Garwood et al., that design includes a vehicle door latch 10 having a rotateable fork-bolt 58 that cooperates with a loop-type striker 144. The striker 144 includes a pair of legs 146 which are secured (e.g., by heading over) to a mounting plate 148, and a generally wedge-shaped crossbar 152. As the door is closed, the leading leg 146 of the striker 144 engages the trailing or outboard edge of the throat 86 of the fork-bolt 58 and rotates it to a latched position where the leading leg of the striker 144 is trapped within the throat 86 as shown in FIG. 1 of that patent. At the same time, the wedge-shaped crossbar 152 of the loop-type striker 144 nests within the generally bell-shaped mouth in the housing 12 defined by the metal plate 160 and wall 162.

A problem with the use of loop-type strikers having wedge-shaped crossbars for nesting in bell-shape mouths in the latches is the inability to easily properly align the striker with the latch during installation thereof on the vehicle, which alignment is essential to keep the door from binding which makes it difficult to open and close the door and result in customer dissatisfaction.

SUMMARY OF THE INVENTION

The present invention contemplates a loop-type striker having a wedge-shaped crossbar which (1) is self-aligning with respect to the bell-shaped mouth with which it is to nest, and (2) reduces installation sensitivity on the vehicle assembly line with respect to precise latch and striker placement. Strikers according to the present invention are rotateable (1) about a pivotal axis extending longitudinally through the leading leg of the striker, and (2) through a sufficiently wide arc as to permit the striker to rotate into compliance with the mouth when the door is closed. More specifically, the present invention involves a loop striker adapted to mate with a door latch having (1) a substantially bell-shaped mouth for receiving a complimentary, wedge-shaped crossbar and a leading leg of the striker, and (2) a rotateable latch-bolt having a throat that traps the leading leg of the striker therein when the latch-bolt is in a latched position. The loop striker has (a) a base for mounting to a doorframe (e.g., door jamb), (b) a leading leg mounted to the base and having a pivotal axis, and (c) a trailing leg carried by the base which is spaced laterally from the leading leg and rotateable about the pivotal axis. By "leading" leg is meant the first of the striker's legs to enter the mouth of the latch. By "trailing" leg is meant the second of the striker's legs to enter the latch's mouth. Each of the legs has (a) a first end adjacent the base, (b) a distal end remote from the first end, and (c) a substantially wedge-shaped crossbar spaced from the base and affixed to the distal end of each of the legs. In accordance with the present invention, the base has an opening for receiving the first end of the trailing leg, which opening is sufficiently larger than such first end that the second leg is moveable therein so as to be rotateable about said pivotal axis through the leading leg in an arcuate path which is determined by the length of the crossbar between the legs, and such that the wedge-shaped crossbar can pivot about the pivotal axis so as to self-align and nest itself with, and in, the bell-shaped mouth upon the closing of the door. Preferably, the opening in the base that receives the trailing leg is an arcuate slot having a curvature the radius of which is equal to the distance between the longitudinal centers of the striker's legs. The leading leg will preferably rotate in the base along with the crossbar. Alternatively, the leading leg will be secured against rotation in the base and the crossbar will rotate relative to the leading leg. A pivot link underlying the base may be connected to the first ends of the legs and either be pivotal about, or with, the first end of the leading leg at the base.

BRIEF DESCRIPTION OF THE DRAWINGS

The invention will better be understood when considered in the light of the following detailed description of certain specific embodiments thereof which are provide hereafter in conjunction with the several drawings in which:

FIG. 3 is an exploded isometric view of the loop-type striker of FIG. 2;

FIG. 4 is similar to FIG. 3, but of a different embodiment of the invention;

FIG. 5 is a sectioned view in the direction 5—5 of FIG. 3; and

FIG. 6 is a sectioned view in the direction 6—6 of FIG. 4.

DETAILED DESCRIPTION OF THE INVENTION

Figure 1:
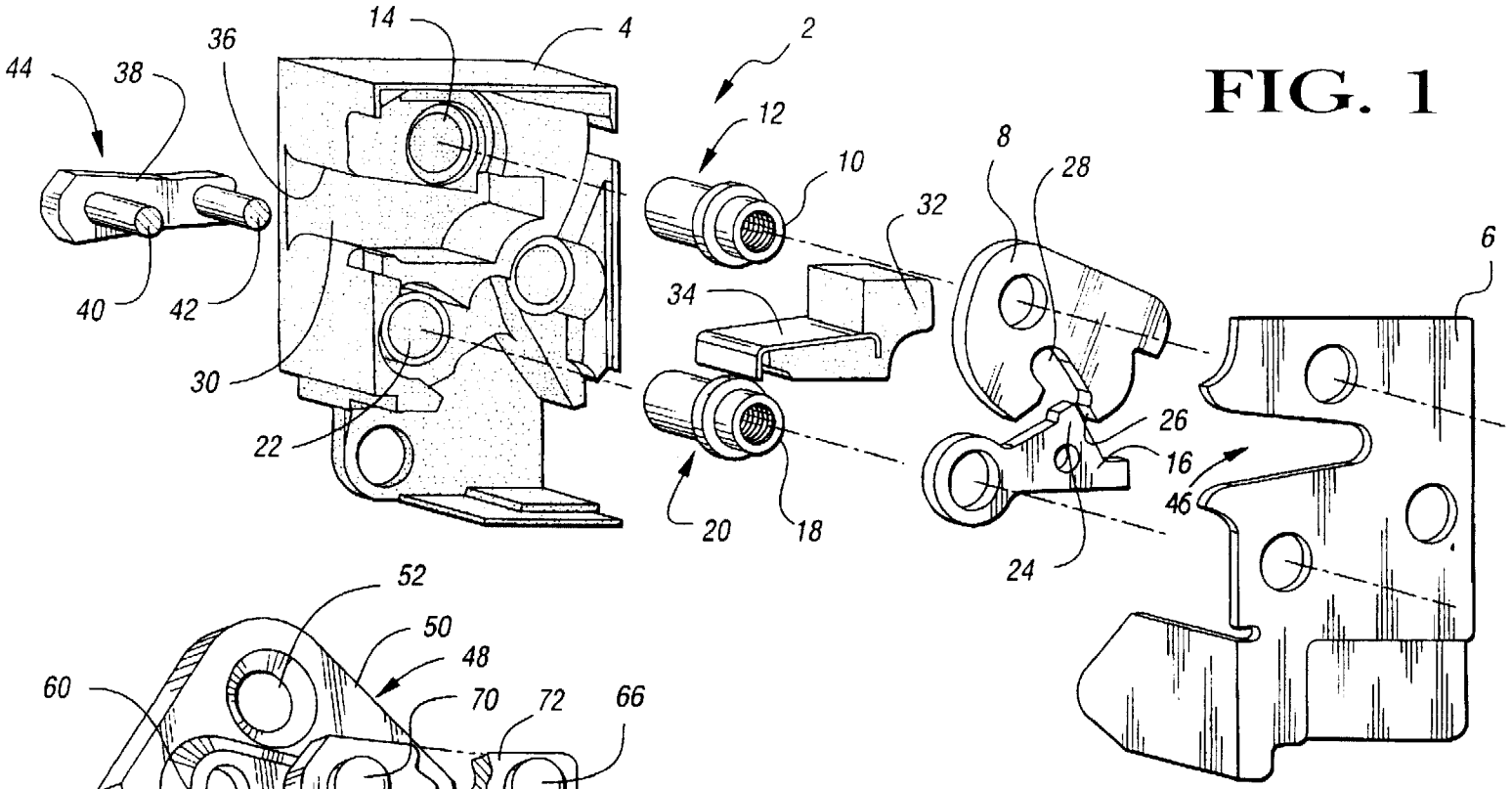
FIG. 1 is an exploded isometric view of a door latch showing only certain key elements thereof necessary to a description and understanding of the present invention.

FIG. 1 is an exploded view of part of a door latch and striker combination showing only those components thereof which relate to an understanding of the present invention, but which does not include other springs, gears, cams, levers, pivots and other linkages which are common to such latches and are well known to those skilled in the art. More specifically, FIG. 1 shows a latch 2 having a plastic housing 4 secured to a metal frame member 6. The housing 4 houses a fork-bolt type latch-bolt 8 adapted to rotate about an outboard end 10 of a bushing 12 which seats in an aperture 14 in the housing 4. The housing 4 also houses a detent 16 which pivots about the outboard end 18 of bushing 20 fitted into opening 22 in housing 4. The detent member 16 includes a shoulder 24 which is engageable with a shoulder 26 on the inboard leg of the latch-bolt throat 28 to locate the latch-bolt in a fully latched position. Clockwise rotation of the detent 16 permits clockwise rotation of the latch-bolt 8 to permit unlatching of the latch 2. The plastic housing 4 includes an opening 30 which receives an insert 32 having a surface 34 thereon. When the insert 32 is positioned in the opening 30, the upper surface 34 on the insert 32 and undersurface 36 of the opening 30 define a generally bell-shaped mouth adapted to receive a complimentary-shaped crossbar 38 on the distal ends of the legs 40 and 42 of a striker 44 which will be described in more detail hereinafter. The frame 6 also includes a bell-shaped opening 46 which receives the leading leg 42 and trailing leg 40 of the striker 44 when the wedge-shaped crossbar 38 is positioned in the opening 30 in the housing 4, thus permitting the throat 28 of the latch-bolt 8 to engage the leading leg 42 (i.e., when latched) to secure the door firmly to the surrounding doorframe.

Figure 2:
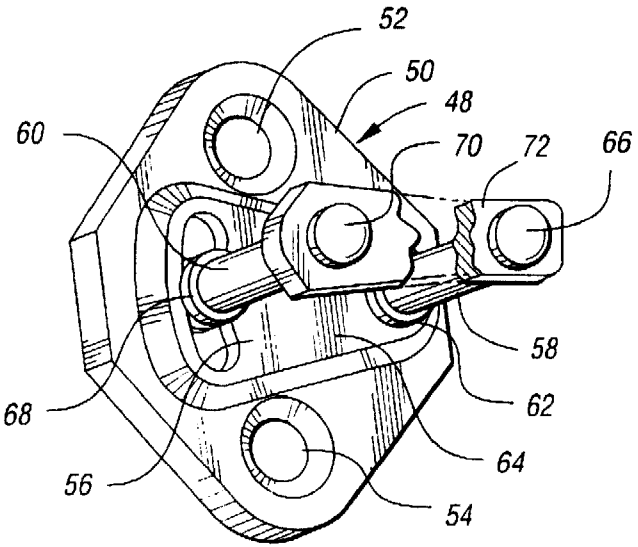
FIG. 2 is an isometric view of a loop-type striker in accordance with the present invention.

FIG. 2 depicts a loop-type striker 48 comprising a base 50 having holes 52 and 54 therethrough for mounting the base 50 to a vehicle doorframe (not shown). The base 50 includes a mesa 56 which in turn supports a first leg 58 (hereafter "leading" leg) and a second leg 60 (hereafter "trailing" leg). The leading leg 58 has a first end 62 mounted to the top 64 of the mesa 56 and a distal end 66 remote from the first end 62. Similarly, the trailing leg 60 has a first end 68 adjacent the top 64 of the mesa 56 but moveable with respect thereto as will be discussed hereinafter. The trailing leg 60 has a distal end 70 remote from the first end 68. A generally wedge-shaped crossbar 72 is affixed to the distal ends 66 and 70 of the leading and trailing legs 58 and 60 respectively. As best shown in FIG. 3 which is an exploded view of the striker 48 shown in FIG. 2, the trailing leg 60 mates with the top 64 of the mesa 56 so as to be slidable in an arcuate slot 74 having a radius corresponding to the length of the crossbar 72 between the longitudinal axes of the leading leg 58 and trailing leg 60. As best shown in FIG. 5, the leading leg 58 has a flange 76 engaging the top 64 of the mesa 56 and is headed over at 78 to engage the underside 80 of the mesa 56. The heading over 78 of the leading leg 58 may be such as to securely anchor the leading leg 58 against rotation in the top of the mesa 56 or alternatively may be loose enough to permit rotation of the leading leg 58 in the hole 82 in the top 64 of the mesa 56. Similarly, the trailing leg 60 will include a flange 84 that overlies the slot 74 and be headed over at the bottom 86 sufficiently to cover the slot 74. Heading over at 86 will be such that the leg 60 may slide in the slot 74 sufficiently to reposition the trailing leg 60 when the door is closed such that the wedge-like crossbar 72 will align itself with and nest in the complimentary bell-shaped opening 30. FIGS. 4 and 6 depict another embodiment of the present invention. More specifically, FIG. 4 is similar to FIG. 3 except that it additionally contains a link 88 underlying the top 64 of the mesa 56 and coupled to the leading and trailing legs 58 and 60 respectively as shown in FIG. 6. In this embodiment, heading over of the leading leg 58 as at 90 must be such as to permit the link 88 to rotate about the pivotal axis 92 of the leading leg 58. In this regard, the link may either rotate with the leading leg 58 if it is loosely fitted into the hole 82 or about the leading leg 58 if it is more securely fitted in the opening 82. The link 88 will also engage the lower end of the trailing leg 60 and will rotate with the leg 60 as it moves in the slot 74 to self-align the wedge-shaped crossbars 72 with the complimentary opening 30 in the housing 4. Provision of the mesa 56 in the base 50 insures that there is enough clearance beneath the base 50 for the leg(s) to move when the base 50 is secured to the doorframe.

While the invention has been disclosed primarily in terms of certain specific embodiments thereof it is not intended to be limited thereto but rather only to the extent set forth hereafter in the claims which follows.

We claim:

1. In a loop striker for use with a door latch having (1) a substantially bell-shaped mouth for receiving a complimentary wedge-shaped crossbar and a leading leg of said striker, and (2) a rotateable fork-bolt having a throat that traps said leading leg therein when the fork-bolt is in a latched position, said loop striker having (a) a base for mounting to a doorframe, (b) a leading leg mounted to said base and having a pivotal axis extending longitudinal through said leg, (c) a trailing leg carried by said base and spaced laterally from said leading leg, (d) a first end on each of said legs adjacent said base, (e) a distal end on each of said legs remote from said first end, and (d) a substantially wedge-shaped crossbar spaced from said base and affixed to said distal end of each of said legs, the improvement comprising: said base having an opening for receiving the first end of said second leg, said opening being sufficiently larger than said first end that said second leg is rotateable about said pivotal axis in an arcuate path determined by the length of said crossbar between said legs, whereby said wedge-shaped crossbar can pivot with respect to said pivotal axis so as to self-align and nest said wedge-shaped crossbar with said bell-shaped mouth upon the closing of said door.

2. A loop striker according to claim 1 wherein said opening comprises an arcuate slot the curvature of which has a radius equal to said length.

3. A loop striker according to claim 1 wherein said leading leg rotates with respect to said base.

4. A loop striker according to claim 3 wherein said crossbar rotates with said leading leg.

5. A loop striker according to claim 1 wherein said crossbar pivots about said leading leg.

6. A loop striker according to claim 1 including a pivot link connected to said first ends and pivotal about said leading leg.

7. A loop striker according to claim 3 including a pivot link connected to said first ends, said pivot link underlying said base and rotateable with said leading leg.

* * * * *